United States Patent [19]

Gudymov et al.

[11] Patent Number: 4,707,163

[45] Date of Patent: Nov. 17, 1987

[54] GASIFICATION OF COAL DUST

[75] Inventors: Ernest Gudymov; Vasilij Fedotov; Vladimir Semenov; Boris Rodinov, all of Moscow, U.S.S.R.; Friedrich Berger, Brand-Erbisdorf; Winfried Wenzel, Freiberg, German Democratic Rep.; Helmut Peise, Frieberg, German Democratic Rep.; Manfred Schingnitz, Freiberg, German Democratic Rep.

[73] Assignees: Brennstoffinstitut Freiberg, Freiberg, German Democratic Rep.; Godsudarstvenny Nauchno Tssledovatelsky I Protektny Institut, Moscow, U.S.S.R.

[21] Appl. No.: 792,476

[22] Filed: Oct. 29, 1985

[51] Int. Cl.[4] ..... C10J 3/48

[52] U.S. Cl. ..... 48/73; 48/67; 48/69; 48/DIG. 2; 122/6 A; 122/7 R

[58] Field of Search ..... 48/77, 73, 67, 69, DIG. 2; 55/69; 122/6 A, 7 R, 235 A, 235 N

[56] References Cited

U.S. PATENT DOCUMENTS

| | | | |
|---|---|---|---|
| 4,309,196 | 1/1982 | Vollhardt | 48/69 |
| 4,314,826 | 2/1982 | Vollhardt | 48/69 |
| 4,328,007 | 5/1982 | Rafael | 48/73 |
| 4,372,253 | 2/1983 | Hibbel et al. | 122/7 R |
| 4,377,132 | 3/1983 | Koog et al. | 48/67 |
| 4,457,764 | 7/1984 | Dorling et al. | 48/DIG. 2 |
| 4,481,014 | 11/1984 | Dorling | 48/DIG. 2 |
| 4,487,611 | 12/1984 | Ziegler | 48/69 |

FOREIGN PATENT DOCUMENTS

| | | | |
|---|---|---|---|
| 2918859 | 11/1980 | Fed. Rep. of Germany | 48/DIG. 2 |

*Primary Examiner*—Peter Kratz

*Attorney, Agent, or Firm*—Michael J. Striker

[57] ABSTRACT

An apparatus for gasifying coal dust has a housing provided with an output fitting for the removal of generator gas and an output fitting for the removal of granulated slag. An overflow maintains a body of liquid in the bottom of the housing and a coal-dust burner in the housing forms a downwardly moving coal-dust flame in an upper reaction zone of the housing. An annular tube wall in the housing upper and lower ends where its tubes are bent apart and form radially throughgoing upper and lower openings and at the burner and therebelow but above the generator-gas output fitting. This tube wall is radially gastight between its upper and lower openings and radially inwardly delimits an axially extending annular passage that is outwardly defined by the housing. Steam is fed to the upwardly directed lances in the passage to create in the housing a toroidal annular current of moving gas and steam rising in the passage and descending in the zones between the flame and the tube wall. A coolant is circulated in the tube wall to cool the current of gas to below the softening temperature of any slag in the flame.

8 Claims, 5 Drawing Figures

GASIFICATION OF COAL DUST

FIELD OF THE INVENTION

The present invention relates to an apparatus for gasifying coal dust. More particularly this invention concerns such a process used in the chemical industry to make a mixture of hydrogen and carbon dioxide from a particulate fuel.

BACKGROUND OF THE INVENTION

A standard coal-dust gasifying apparatus such as described in German patent document No. 2,705,558 has a housing with an output fitting for the removal of generator gas and an output fitting for the removal of granulated slag, a funnel guide for conducting granulated slag in the housing to the slag-output fitting, a coal-dust burner capable of forming a coal-dust flame in an upper reaction zone of the housing, and an overflow apparatus for maintaining a body of liquid in the bottom of the housing. A high-temperature thermal protection lining is provided in the upper reaction zone of the housing and this reaction zone has a restricted lower end. A laterally gastight tube wall in the housing in a lower cooling zone beneath the reaction zone has upper and lower manifolds and radially inwardly delimits an axially extending annular passage radially outwardly defined by the housing.

Such an arrangement has substantial disadvantages. First of all the thermal lining of the reaction zone is rapidly eroded by the molten particles of slag present in this region. In fact a standard refractory lining is eroded from 10 mm to 40 mm in 200 h of operation, whereupon the apparatus must be shut down and relined. In addition the molten slag solidifies in the restricted lower end of the thermal lining and crusts on the lining at this level. This further restricts flow through the apparatus by clogging it at this critical level and considerably reduces operating efficiency. In addition the still molten paticles in the downwardly moving gas stream stick to the cool walls of the tube wall and crust up thereon also. The result of this is another restriction of flow and a substantial loss of heat-exchange efficiency so that the apparatus is less efficient with reduced throughput and a hotter output gas, and needs frequent opening and cleaning.

In Russian patent document No. 3,359,368 an arrangement is described of the above-described type wherein the tube wall is restricted centrally to form an upper reaction zone and a lower radiation or cooling zone. The gas outlet opens into the cooling zone and the tube wall is studded in the reaction zone so it can carry a layer of insulating material. The lower part of the tube wall is formed of two concentrically arranged and radially gastight portions, forming upper and lower radial throughgoing openings by bending in and out the individual tubes.

In such an apparatus the gas temperature upstream of the central restriction of the tube wall is 100° C. to 200° C. above the melting temperature of the slag, so that more heat must be dissipated downstream in the cooling zone. The overall operation temperature of the apparatus is therefore increased considerably so that some of the product gas is combusted, thereby substantially reducing the efficiency of the system both by wasting the product and raising the product's temperature. In addition the lining of the upper portion of the tube wall is subjected to very high temperatures and therefore has a very short service life. What is more the slag can crust up at the upstream end of the cooling zone as in the other above-described system. Finally, the use of a centrally restricted apparatus necessitates operating the system at substantially higher input pressure, which once again represents a reduction in operating efficiency.

OBJECTS OF THE INVENTION

It is therefore an object of the present invention to provide an improved apparatus for gasifying coal.

Another object is the provision of such an apparatus for gasifying coal which overcomes the above-given disadvantages, that is which operates efficiently, produces an output gas with a high percentage of combustibles, and which goes a long time between servicings.

A further object is to provide an improved method of gasifying coal or other particulate carbon and an improved method of operating an apparatus for gasifying coal.

SUMMARY OF THE INVENTION

An apparatus for gasifying coal dust according to the invention has a housing provided with an output fitting for the removal of generator gas and an output fitting for the removal of granulated slag. The housing also has an upper reaction zone and immediately therebelow a lower cooling zone. An overflow maintains a body of liquid in the bottom of the housing and a coal-dust burner in the housing forms a downwardly moving coal-dust flame in the upper reaction zone of the housing. An annular tube wall in the housing has intake and output manifolds and upper and lower ends where its tubes are bent apart and form radially throughgoing upper and lower openings respectively in the reaction and cooling zones and at the burner and above the generator-gas output fitting. In addition the tube wall is radially gastight between its upper and lower openings and radially inwardly delimits an axially extending annular passage that is outwardly defined by the housing and that is mainly of uniform cross section but that flares upwardly immediately below the upper openings. A funnel guide in the cooling zone conducts granulated slag in the housing to the slag-output fitting and a steam manifold in the housing is provided with a plurality of lances opening upward in the annular passage above the lower openings. Steam is fed to the steam manifold to create in the housing a toroidal annular current of moving gas and steam rising in the passage and descending in the zones between the flame and the tube wall. A coolant is circulated between the tube-wall manifolds to cool the current of gas to below the softening temperature of any slag in the flame.

Thus in its simplest terms the instant invention comprises the method or process comprising the steps of burning coal dust in an upper reaction zone of a gas-containing housing vessel to form a downwardly projecting flame containing molten slag, circulating the gas in the chamber as an outwardly raising and inwardly falling inverting toroid extending generally from above the flame to the lower end of a cooling zone below the reaction zone, cooling the inverting toroidal current of gas to a temperature below the softening temperature of the slag in the flame and thereby cooling and solidifying any molten slag before it can contact the housing, and withdrawing gas from within the housing from the lower cooling zone outside the inverting toroidal current. The toroidal current is cooled by flowing it around a tube wall that extends vertically in the vessel around the flame and by cooling this tube wall. The gas is circulated by injecting steam or another suitable gas under pressure upward between the housing and the tube wall.

This system gives a substantial increase in operational efficiency because it can function at a substantially lower temperature than any of the prior-art arrangements. In addition the inverting toroid of gas that completely surrounds the flame from the very tip of the burner keeps any molten slag out of contact with any part of the apparatus, thereby greatly increasing its service life both by eliminating any erosion of the lining or tubes and preventing any crusting of the slag on the tubes. At the same time this recirculating body of gas keeps the burner tip perfectly clean, as the reversal at the bottom of the apparatus separates out any slag which by the time it is at the bottom of the apparatus has solidified.

According to another feature of this invention some of the tubes of the tube wall are bent in to closely surround the burner and form the upper openings at the upper wall end. In addition one of the manifolds of the tube wall is below the level of the body of water in the housing and some of the tubes of the tube wall are bent out toward the housing and form the lower openings and the generator-gas outlet fitting are above the body of water and below the lower openings.

For ease of service and processing of coal that burns at high temperature the tube wall includes an upright an inner annular portion forming the passage and extending between the openings and an outer portion extending vertically in the passage between the inner wall and the housing and connected at the lower end of the inner wall thereto at the openings. Here the tube-wall manifolds are both at the upper end of the housing.

Another machine for high-temperature, low-ash, and low-throughput use has a supplementary heat exchanger in the passage between the tube wall and the housing and lying vertically between the lower openings and the flared passage portion.

The tube wall according to this invention tapers at between 6° and 15°1 at the flaring passage portion. A taper of less than 6° produces no appreciable affect, whereas more than 15° creates turbulence. This taper reduces pressure loss in the system, thereby increasing operating efficiency.

DESCRIPTION OF THE DRAWING

The above and other features and advantages will become more readily apparent from the following, it being understood that any feature described with reference to one embodiment of the invention can be used where possible with any other embodiment. In the accompanying drawing.

SPECIFIC DESCRIPTION

Figure 1:
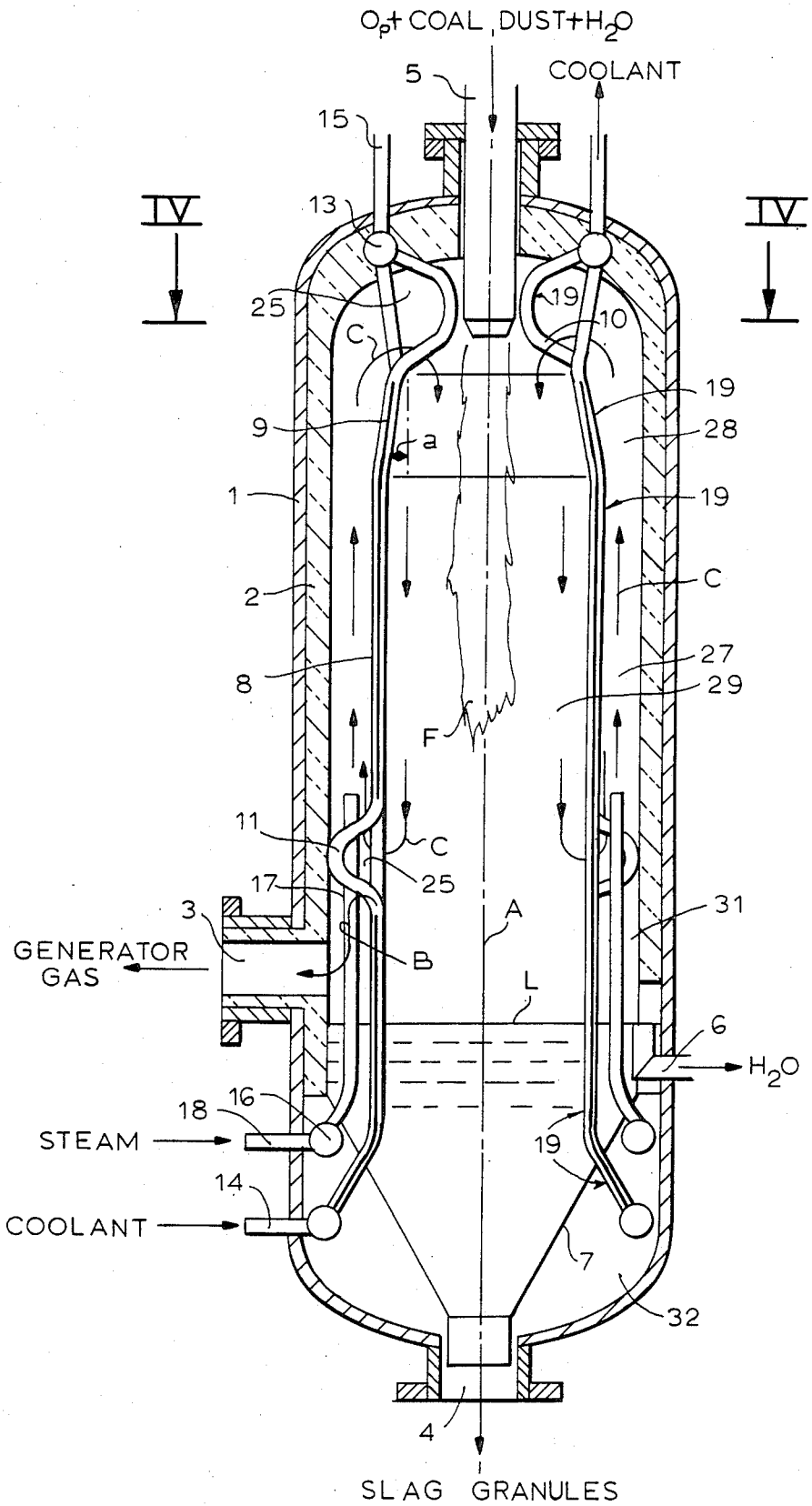
FIG. 1 is a vertical axial section partly in diagrammatic form through a gasification apparatus according to this invention.
Figure 4:
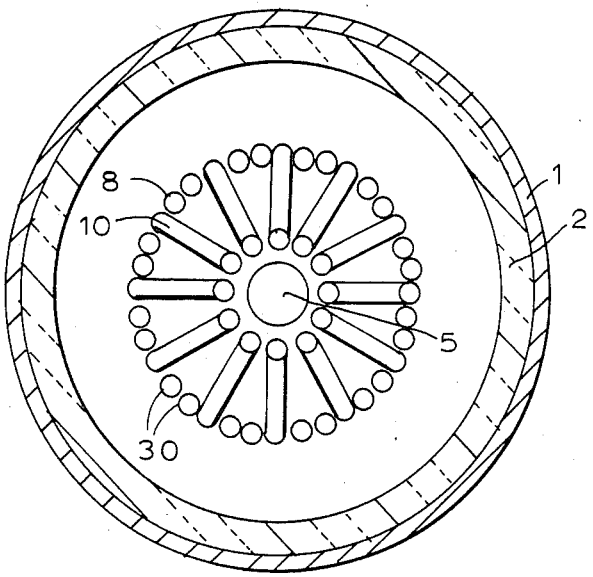
FIGS. 4 and 5 are cross sections taken respectively along lines IV—IV and V—V of FIGS. 1 and 2.

As seen in FIGS. 1 and 4 a gasifying apparatus has an upright and substantially cylindrical housing 1 centered on an axis A and provided with a thermally insulating lining 2. A generator-gas outlet fitting 3 opens radially of the axis A into the housing 31 and an outlet fitting 4 for slag granules opens axially downward from the lower end of the housing 1. A coal-dust burner 5 projects axially down through the top of the housing 1 into its interior. A water level L slightly below the outlet 3 is maintained in the housing 1 by an overflow pipe 6. A collecting funnel 7 wholly below this level L serves to guide particulate slag in the water down to the outlet 4.

An array of mainly vertical tubes 30 extends between a lower annular manifold 12 well below the level L and centered on the axis A to an upper annular manifold 13 also centered on the axis A and imbedded in the lining 2 at the upper end of the housing 1. Input and outtake tubes 14 and 15 connected respectively to the manifold rings 12 and 13 are connected to an unillustrated pump and cooling system to feed a coolant such as water or steam into the lower manifold 12 and extract it from the upper manifold 13, thereby cooling the tubes 30. These tubes 30 form a radially closed and gastight cylindrical wall 8 defining with the inner wall of the lined housing 1 an annular and vertically extending space 27 of constant section. Every third tube 30 is bent outward in a U or lens shape at 11 to form at this region a multiplicity of openings 25. Similarly at the upper end of the system every third tube 30 is bent inward at 10 to closely surround the burner nozzle 5 and form upper radial openings 26. The upper halves of the bent-in regions 10 are angularly interconnected by webs or welds 19 as are the tubes 30 between the openings 25 and 26 and below the openings 25. The welds or webs 19 prevent any radial passage of gas between the tubes 30 except at the openings 25 and 26. In addition the tubes 30 are bent in at an angle a here of 8° at a region 9 immediately below the openings 26 and above the straight section 8 to form a frustocone and to create a region 28 of upwardly increasing cross section that forms an upward extension of the region 27.

A steam manifold 16 in the housing 1 below the level L is connected to a feed line 18 that pressurizes it with steam or an inert gas, and carries an array of identical upright lances 17 that open upward in the space 27 immediately above the openings 25. The gas outlet 3 is below the openings 25 in an annular region 31.

The apparatus described above is operated as follows:

To start with the housing 1 is pressurized with an inert gas such as argon to the pressure at which it is supposed to operate and is filled to the level L with a body 32 of water, any excess draining off via the pipe 6. Then a mixture of an oxygen-containing gas such as air, coal dust, and steam is fed to the burner nozzle 5 to produce a flame F extending downward along the axis A from the tip of the burner 5. Simultaneously steam is injected by the lances 17 upward into the region 27.

As a result the steam injected under pressure by the lances 17 forces the gas in the space 27 to move upward, sucking in gas from the interior region 29. The rising mixture of steam and gas slows somewhat in the region 28, then reverses direction as it is forced through the openings 26, and then it descends in the inner area 29 to be again sucked out through the holes 25, forming an inverting toroid indicated at arrows C. At the same time the flame F is also adding material to the interior of the vessel 1, so that an overpressure results and generator gas mixed with the original inert gas can be bled off from the lower region 31 beneath the openings 25 through the outlet 3 as indicated by arrow B to keep the pressure inside the housing 1 constant. As the operation takes place the inert gas will be displaced by the generator gas until it is gone.

With this system the molten particulate slag formed in the flame F is held away from the tubes 30 by the inverting toroidal flow C of gas, which is at a temperature of 800° C. to 900° C., well below the softening point of the slag. The molten material will have to pass through this cool gas to contact the tubes 30, so that it will not be able to contact these tubes in sticky liquid form. In fact the slag will be almost completely solidified by the time it reaches the level of the openings 25 so that it will simply fall into the body 32 of water collected at the bottom of the housing 1. As a result there will be no crusting of the slag on the tubes 30 or any other part of the structure.

The Table given below compares the operational characteristics of the above-described instant invention (Inst. Inv.) and a typical prior-art machine comprising:

a housing with an output fitting for the removal of generator gas and an output fitting for the removal of granulated slag;

a funnel guide for conducting granulated slag in the housing to the slag-output fitting;

a coal-dust burner in the housing capable of forming a coal-dust flame in an upper reaction zone of the housing;

an overflow apparatus for maintaining a body of liquid in the bottom of the housing;

a high-temperature thermal protection lining in the upper reaction zone of the housing, the reaction zone having a restricted lower end;

a laterally gastight tube wall in a lower radiation or cooling zone of the housing beneath the reaction zone having upper and lower manifolds and radially inwardly delimiting an axially extending annular passage radially outwardly defined by the housing; and means for circulating a coolant between the tube-wall manifolds.

TABLE

| Characteristic | Prior art | Inst. Inv. | Variation |
|---|---|---|---|
| Coal-dust input | 25/h = | 25t/h | None |
| Internal pressure | 30 atm = | 30 atm | None |
| Ave. temp. in reaction zone | 1700° C. | 1450° C. | −14.7% |
| Heat loss in reaction zone | 5990 megkcal/h | 3100 megcal/hr | −51.8% |
| $O_2$ consumption | 13,860 $Nm^3/h$ | 12,060 $Nm^3/h$ | −13% |
| Steam input | 7t/h | 6t/h | −14.3% |
| $O_2$ consumption per 1000 $Nm^3$ of $H_2$ + CO produced | 451 $Nm^3/h$ | 353 $Nm^3h$ | −28% |
| Output gas composition (vol.) | | | |
| CO | 41.01% | 42.97% | +4.8% |
| $H_2$ | 19.93% | 24.88% | +24.8% |
| $H_2O$ | 22.47% | 17.62% | −21.3% |
| $CO_2$ | 10.34% | 8.52% | −17.6% |
| $N_2$ | 4.39% | 4.18% | −4.8% |
| $H_2S$ | 1.83% | 1.83% | None |
| Output of $H_2$ + CO | 30,700 $Nm^3/h$ | 34,120 $Nm^3/h$ | +11% |

The above-given data therefore indicate that the apparatus of the instant invention, while working at the same coal-dust input and at the same pressure, operates much more efficiently than the prior-art system. Reaction-zone temperature is decreased with a corresponding decrease by over half in heat consumption by the system. As a result the consumptions of oxygen and steam are both significantly reduced since actual combustion rather than conversion is reduced. On the other hand the percentage of combustible components—hydrogen and carbon monoxide—in the output gas is increased and the portion of relatively noncombustible components—water, carbon dioxide, and nitrogen—decreases, while the level of pollutants—mainly hydrogen sulfide—remains the same. The apparatus therefore functions substantially better than that of the prior art.

The increase in operating efficiency is accompanied in the instant invention by a substantial increase in service life for the equipment as well as a corresponding decrease in maintenance. So long as there are molten slag particles in the housing they are held by the current C out of engagement with virtually any of its parts. Only after traveling all the way down to the openings 25, while losing heat both radiantly to the wall 8 and conductively to the cooler gas stream C, can they physically engage the structure of the apparatus. By this time they are hard nonsticky particles and in any case the change in direction at the holes 25 inertially separates the solid particles from the surrounding gas stream.

Figure 2:
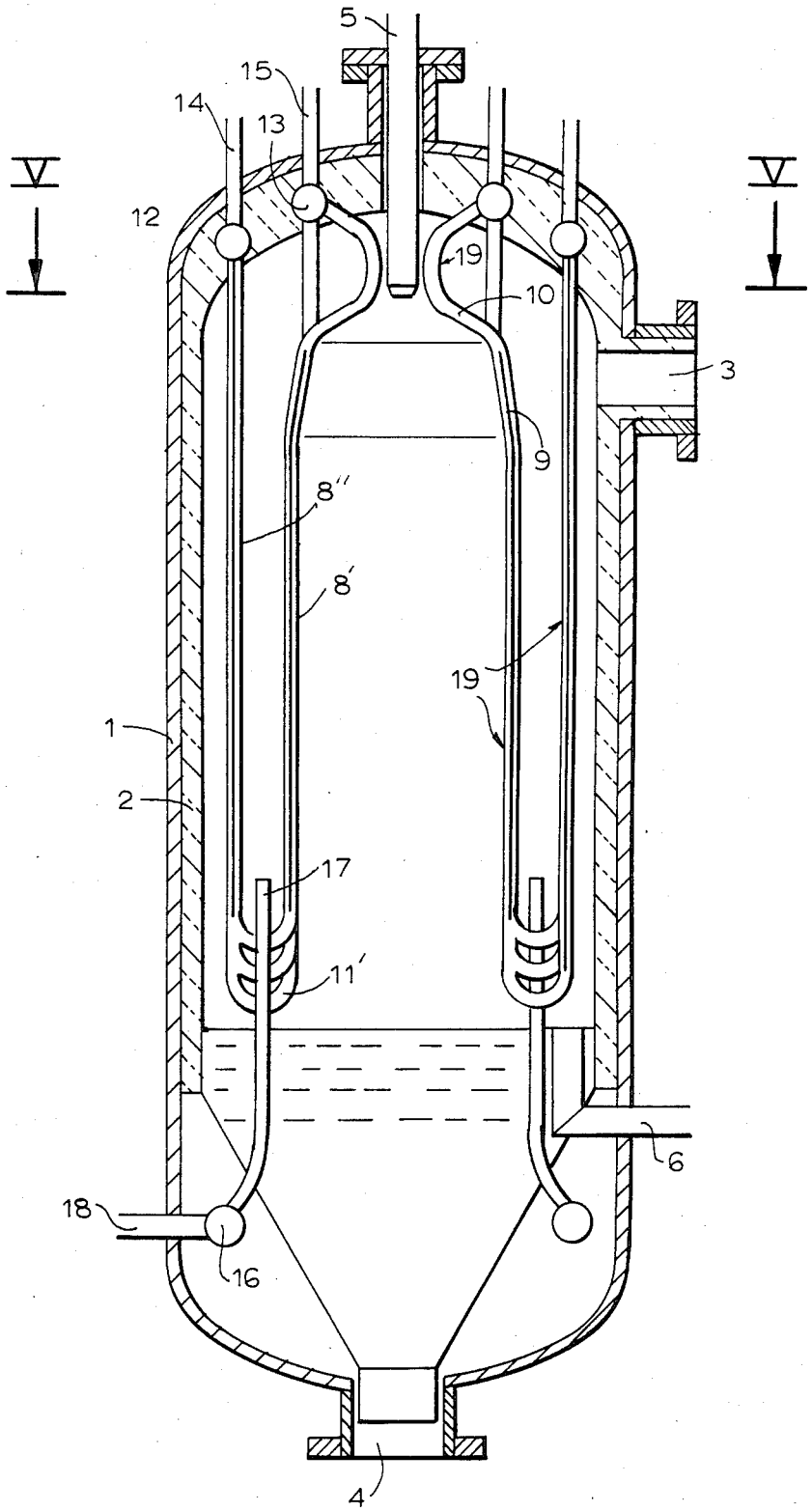
FIGS. 2 and 3 are vertical axial sections through two more gasification devices in accordance with this invention.
Figure 3:
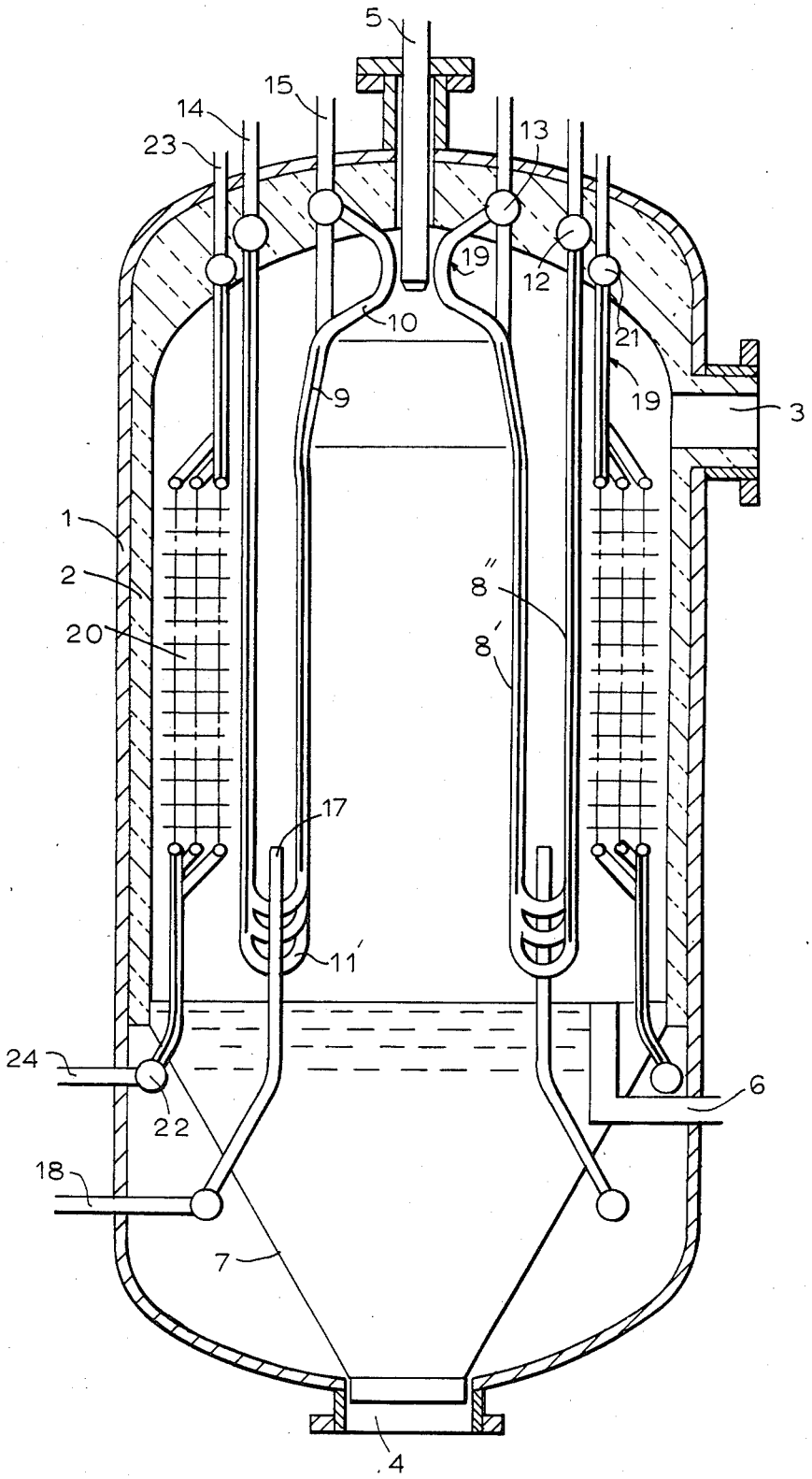
Figure 5:
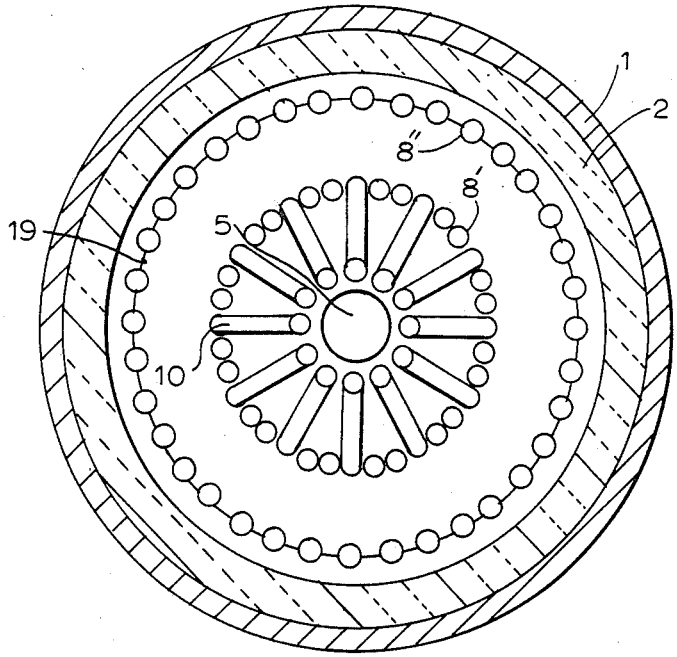

In FIGS. 2 and 5, which use the same references as FIG. 1 for functionally identical structure, the tubes form an inner tube wall 8' identical to the wall 8 of FIG. 1 and an outer wall 8'' that extends vertically between the inner wall 8' and the outer wall 8''. Both walls 8' and 8'' are interconnected by webs or welds 19 and the bent apart portions 11' are upwardly, not inwardly, concave. Thus the incoming coolant manifold 12 can be imbedded in the lining 2 at the top of the apparatus outside the outgoing manifold 13. The arrangement of FIG. 3 is identical, except that a supplementary array 20 of cooling tubes is provided between the outer wall 8'' and the housing 1. Upper and lower manifolds 21 and 22 connected to respective coolant lines 23 and 24 permit a coolant to flow through these arrays 20.

The arrangements of FIGS. 2 and 5 can be used at substantially higher temperatures than that of FIGS. 1 and 4, and that of FIG. 3 can be used at yet higher temperatures. This is useful for some types of coal or other carbon-containing particulate material that must be combusted at such higher temperature for its gasification. In addition this second embodiment is particularly easy to service, as the entire housing 1 can be set up to separate just below its top wall, which allows all the internal parts to be serviced since everything practically hangs from this top wall. More particularly the apparatus of FIGS. 1 and 4 is particularly useful for coal having a low softening temperature as well as for coal with salt in the ash. The arrangement of FIGS. 2 and 5 is particularly good for coal which burns at a high temperature, and the arrangement of FIG. 3 is also for high-temperature combustion, but for low ash levels and a relatively small throughput.

We claim:

1. An apparatus for gasifying coal dust, the apparatus comprising:

a vertical cylindrical housing provided with an output fitting for the removal of generator gas and an output fitting for the removal of granulated slag, the housing having an upper reaction zone and immediately therebelow a lower cooling zone;

a high-temperature thermal protection lining in the housing;

means including an overflow for maintaining a body of liquid in the bottom of the housing;

means including a coal-dust burner in the housing for forming a downwardly moving coal-dust flame in the upper reaction zone of the housing;

an annular tube wall positioned in the housing and having intake and output manifolds and upper and lower ends where its tubes are bent apart to form radially throughgoing upper and lower openings, respectively at the burner and above the generator gas output fitting, the tube wall further being radially gastight between said upper and lower openings and defining with said housing an axially extending annular passage that is outwardly limited by the housing and which is mainly of uniform cross section but that flares upwardly immediately below the upper openings;

a funnel guide in the cooling zone for conduction granulated slag in the housing to the slag-output fitting;

a steam manifold positioned in the housing and provided with a plurality of lances opening upwardly in the annular passage above the lower openings;

means for feeding steam to the steam manifold and thereby creating in the housing a toroidal annular current of moving gas and steam rising in the passage and descending in the zones between the flame and the tube wall; and means for circulating a coolant between the tube-wall manifolds and thereby cooling the current of gas to below the softening temperature of any slag in the flame.

2. The coal-gasifying apparatus defined in claim 1, wherein some of the tubes of the tube wall are bent in to closely surround the burner and form the upper openings at the upper wall end.

3. The coal-gasifying apparatus defined in claim 2 wherein one of the manifolds of the tube wall is below the level of the body of water in the housing and some of the tubes of the tube wall are bent out toward the housing and form the lower openings, the generator-gas outlet fitting being above the body of water and below the lower openings.

4. The coal-gasifying apparatus defined in claim 1 wherein the tube wall includes an upright inner annular portion forming the passage and extending between the openings and an outer portion extending vertically in the passage between the inner wall and the housing and connected at the lower end of the inner wall thereto at the openings, the tube-wall manifolds both being at the upper end of the housing.

5. The coal-gasifying apparatus defined in claim 1 further comprising a supplementary heat exchanger in the passage between the tube wall and the housing and lying vertically between the lower openings and the flared passage portion.

6. The coal-gasifying apparatus defined in claim 1 wherein the tube wall tapers at between 6° and 15° at the flaring passage portion.

7. An apparatus for gasifying coal dust, the apparatus comprising:

a vertical cylindrical housing provided with an output fitting for the removal of generator gas and an output fitting for the removal of granulated slag, the housing having an upper reaction zone and immediately therebelow a lower cooling zone;

means including an overflow for maintaining a body of liquid in the bottom of the lower cooling zone;

means including coal-dust burner in the housing for forming a downwardly moving and slag containing coal-dust flame at the upper end of the upper reaction zone of the housing;

an annular tube wall in the housing formed with radially throughgoing upper and lower openings respectively at the upper end of the reaction zone and in the cooling zone, the tube wall further being radially gastight between its upper and lower openings and redially inwardly delimiting an axially extending annular passage outwardly defined by the housing;

an annular array of lances opening upwardly in the annular passage above the lower openings;

means for feeding steam to the lances and thereby creating in the housing a toroidal annular current of moving gas and steam rising in the passage and descending in the zones between the flame and the tube wall; and means for circulating a coolant between the tube-wall manifolds and thereby cooling the current of gas to below the softening temerature of any slag in the flame, wherein some of the tubes of the wall are bent inward at the upper end of the reaction zone to closely surround the burner and form the upper openings.

8. The coal-gasifying apparatus defined in claim 7, wherein some of the tubes of the wall are bent radially outward in the cooling zone toward the housing and thereby form the lower openings.

* * * * *